US006065184A

United States Patent [19]

Drury

[11] Patent Number: 6,065,184

[45] Date of Patent: May 23, 2000

[54] APPARATUS FOR AUTOMATIC CLOSING OF SLIDING DOORS

[75] Inventor: Malcolm Drury, Leeds, United Kingdom

[73] Assignee: Malcoln Drury, Leeds, United Kingdom

[21] Appl. No.: 09/091,682

[22] PCT Filed: Dec. 17, 1996

[86] PCT No.: PCT/GB96/03113

§ 371 Date: Jun. 19, 1998

§ 102(e) Date: Jun. 19, 1998

[87] PCT Pub. No.: WO97/23701

PCT Pub. Date: Jul. 3, 1997

[30] Foreign Application Priority Data

| | | | |
|---|---|---|---|
| Dec. 21, 1995 | [GB] | United Kingdom | 9526242 |
| Apr. 3, 1996 | [GB] | United Kingdom | 9607086 |
| May 31, 1996 | [GB] | United Kingdom | 9611355 |

[51] Int. Cl.[7] ..... E05F 1/00

[52] U.S. Cl. ..... 16/81

[58] Field of Search ..... 16/81, 71, 78, 16/76; 49/404, 407, 408

[56] References Cited

U.S. PATENT DOCUMENTS

| | | | |
|---|---|---|---|
| 264,881 | 9/1882 | Johnston | 16/81 |
| 617,159 | 1/1899 | Hogan et al. | 16/81 |
| 1,589,842 | 6/1926 | Davis . | |
| 3,018,507 | 1/1962 | Launer | 16/78 |
| 3,274,733 | 9/1966 | Bailey | 16/81 |
| 3,334,444 | 8/1967 | Hargrove | 16/81 |
| 4,003,102 | 1/1977 | Hawks et al. . | |
| 4,357,732 | 11/1982 | Hickman . | |
| 4,649,598 | 3/1987 | Kinsey et al. . | |
| 4,884,369 | 12/1989 | Tatham . | |
| 4,891,911 | 1/1990 | Yung | 49/404 |
| 5,285,596 | 2/1994 | Kinsey | 49/404 |
| 5,579,607 | 12/1996 | Braid | 49/404 |

FOREIGN PATENT DOCUMENTS

| | | | |
|---|---|---|---|
| 550152 | 3/1983 | Australia . | |
| 73.01365 | 8/1974 | France . | |
| 1178739 | 9/1964 | Germany | 16/81 |

*Primary Examiner*—Chuck Y. Mah

*Attorney, Agent, or Firm*—Reising, Ethington, Barnes, Kisselle, et al

[57] ABSTRACT

Apparatus (20) for automatically closing a sliding door (40), comprising a pneumatically controlled weighted piston (1) within a vertical tube 5' for operative connection to a sliding panel (13) forming part of a sliding door assembly such that sliding the panel into the open door position lifts the piston which then falls again under its own weight with pneumatic control once the sliding panel is released, thus closing the door.

12 Claims, 7 Drawing Sheets

APPARATUS FOR AUTOMATIC CLOSING OF SLIDING DOORS

The present invention relates to apparatus for effecting the automatic closing of a sliding door, following manual opening. The type of sliding door to which the invention relates in particular is an arrangement whereby a sliding panel moves over a fixed panel, such as for example a patio door.

The invention is particularly advantageous in hot climates, where air-conditioning systems rapidly lose efficiency if patio doors are left open, but also finds applications in more temperate climates, perhaps in autumn and spring when the patio doors are still being used whilst the central heating system is on.

Australian patent specification number AU-B-75066/81 discloses a door closer with a counter-weight restrained to move substantially vertically within a tube, and a linkage between the counter-weight and the door arranged so that the counterweight rises as the door opens and falls as the door closes.

According to a first aspect of the present invention there is provided apparatus for automatically closing a sliding door comprising a weight for operative connection to a sliding panel forming part of a sliding door assembly such that sliding the panel into the open door position lifts the weight which then falls again once the sliding panel is released, thus closing the door, which apparatus comprises; a vertically extending pneumatic tube wherein the weight in the form of a piston is guided, and a pulley for guiding a cable fixed to the sliding panel, wherein the movement of the piston within the pneumatic tube is dampened by means of check valve and throttle allowing admission and restricted outflow of air respectively, characterised by, arranged independently of the door but mounted thereto, an assembly comprising first and second tubes joined rectangularly by an elbow, wherein the first vertical tube is the pneumatic tube for the cable and the weight piston, the elbow houses the cable and the pulley, and the horizontally extending second tube houses the cable and supports at the distal end thereof a second pulley, such that the end of the cable fixed to the moving panel draws the moving panel by weight of the piston in a direction away from the pneumatic tube.

The piston, which conveniently is of generally cylindrical shape, includes air seals close to each end, which create an airtight seal with the inner surface of the tube. The tube is open at its upper end, but closed at the bottom end where one or more air valves are included.

Preferably, there is provided a single air valve in the form of a by-pass flow control valve, comprising a one-way flow valve with a screwed sleeve underneath. This valve allows air to be drawn into the tube beneath the piston upon raising of same (i.e opening of the door), and also allows the controlled release of air from the tube beneath the piston upon falling of same (i.e closing of the door). By turning the screwed sleeve clockwise, the valve is pressed up, holding it slightly off its seal and allowing the air, after initial compression, to escape slowly around the valve and through the sleeve. By turning the screwed sleeve dial clockwise, the air escapes faster and the door closes quicker, and by turning it anti-clockwise, the air escapes more slowly and the door closes more slowly. Thus, the screwed sleeve can be set to control the desired speed of door closure, and after the initial compression of the air, the piston will then fall at the selected steady rate, rather than accelerating under free fall.

This overcomes the problem of having to have quite a heavy piston in order to overcome the static friction to get the sliding panel moving in the first instance.

In an alternative embodiment, there is a combined seal/one way valve fixed to the base of the piston and adapted such as to allow air to flow through the seal when the piston is lifted upon opening the door, but to prevent such air flow when the piston is falling, thereby creating a substantially airtight seal and compressing the air within the tube beneath the piston, permitting smooth closing operation.

The apparatus may include additional weights which may be required, to be attached onto or adjacent the piston, for different door assemblies.

According to a second aspect of the present invention there is provided a method of converting a manually operated sliding door assembly having at least one sliding panel into one which closes automatically, the method comprising mounting onto the door assembly an apparatus according to claim 1.

According to a third aspect of the present invention there is provided an automatically closing sliding door assembly including at least one sliding panel, including an apparatus according to claim 1.

Embodiments of the present invention will now be described, by way of example only, with reference to the accompanying drawings, in which:

FIG. 1 is a plan view of the apparatus according to the invention,

FIG. 1*a* illustrates the enclosed pulley of FIG. 1 in more detail,

Figure 4B:
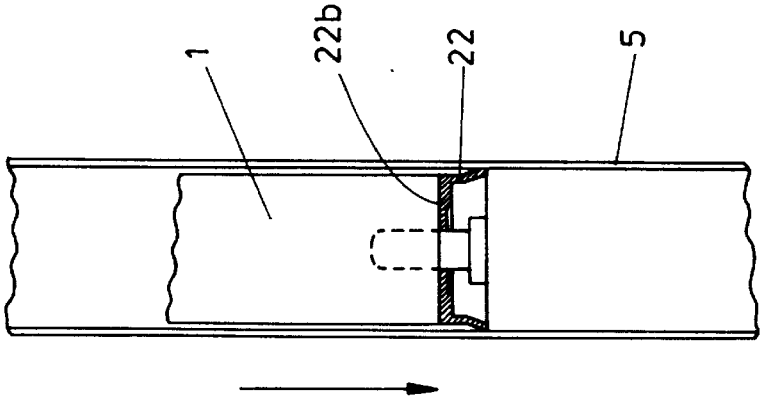
FIG. 4 illustrates an alternative embodiment of the invention.
Figure 4C:
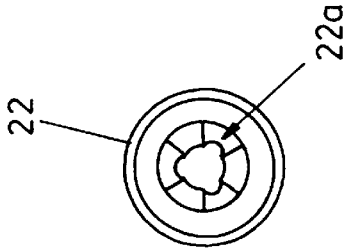
Figure 4A:
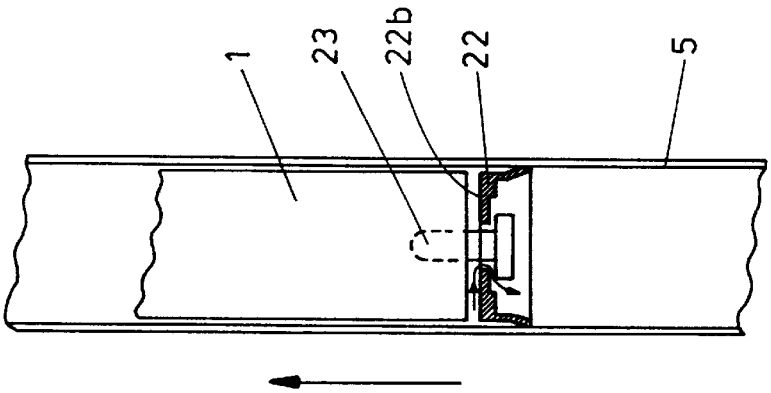
Figure 5A:
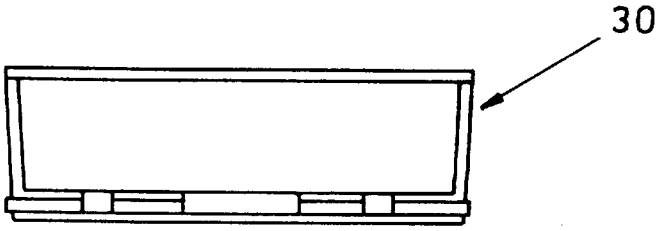
Figure 5B:
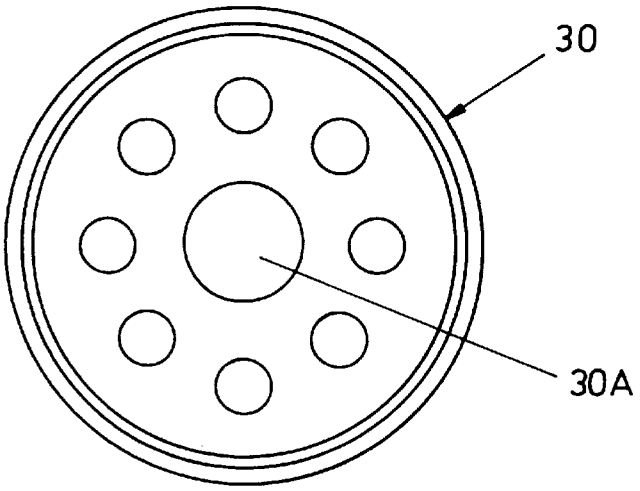
Figure 5C:
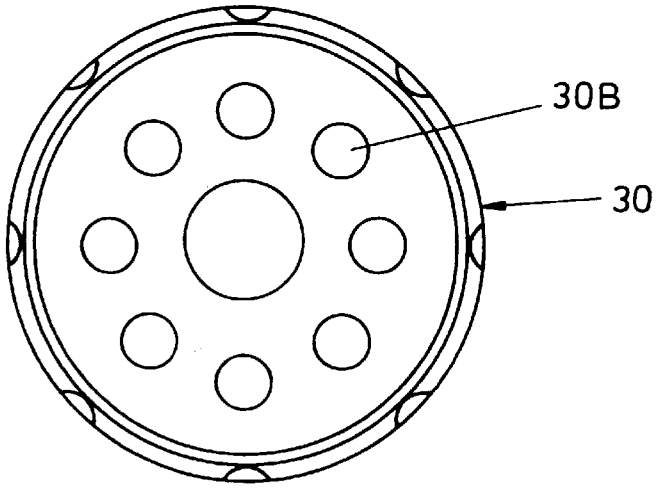
Figure 6:
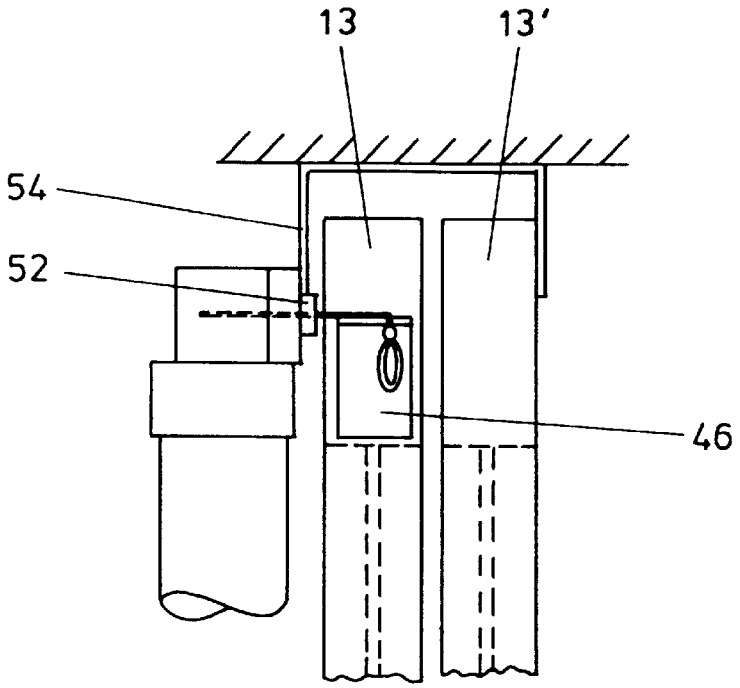
Figure 7:
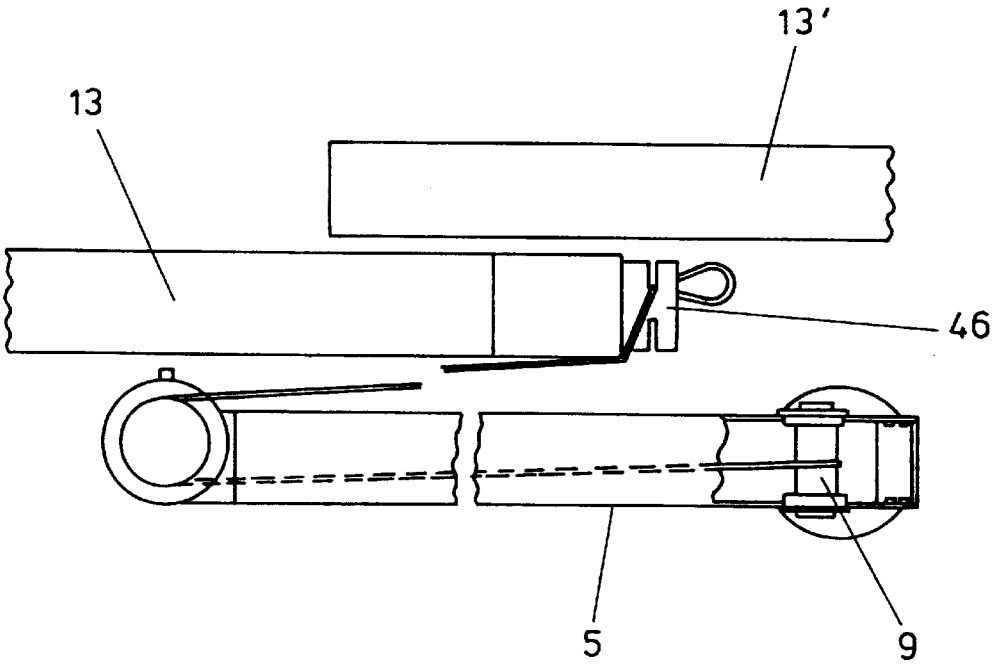
Figure 8:
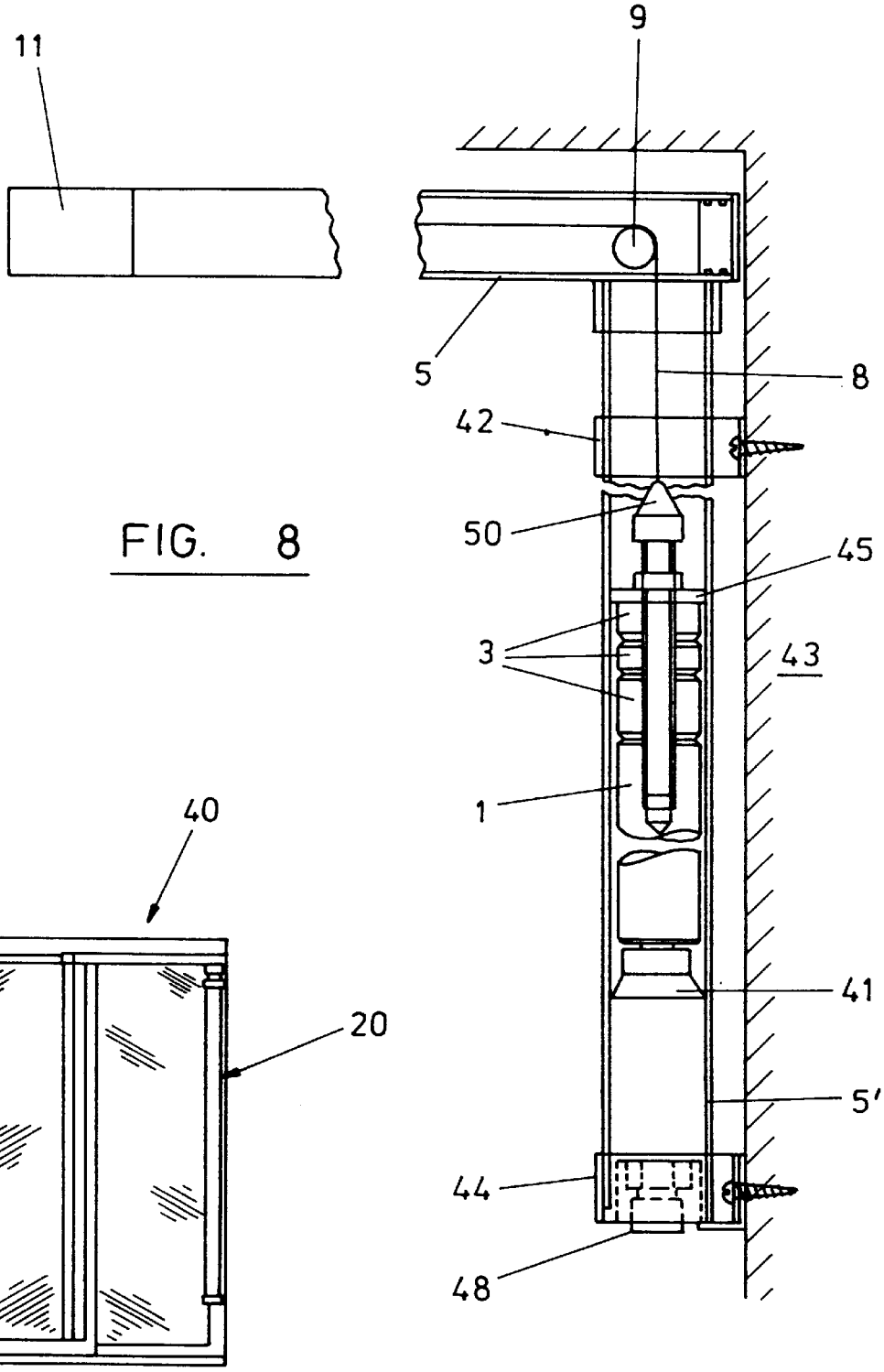
Figure 9:
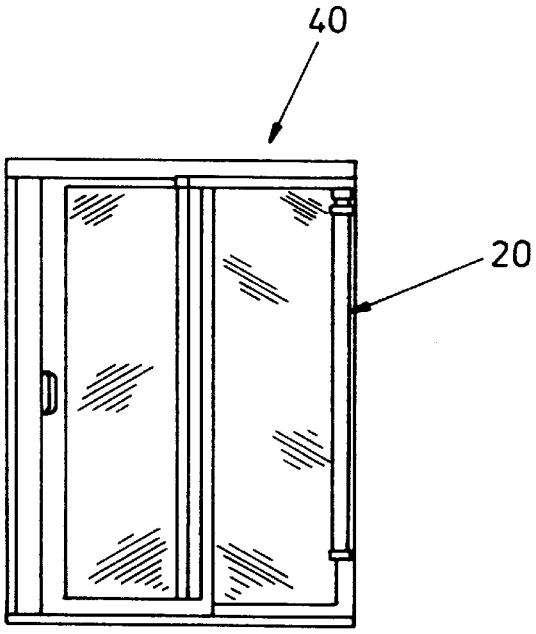

FIGS. 4A, 4B and 4C all illustrate in detail one version of the combined seal/one way valve and its sequence of operation, FIGS. 5A, 5B and 5C all illustrate in detail an alternative version of the combined seal/one way valve, and FIGS. 6 through 9 illustrate in greater detail the installation of the apparatus to standard sliding doors.

Referring to the drawings, apparatus 20 for effecting the automatic closing of a sliding door 13 comprises a weight 1 connected by a cord 8 to a bracket 13*a* fixed to a back—13*b* edge of the sliding door panel 13. The cord 8 passes through two smooth bore tubes 5, disposed generally at right angles to each other and connected together by means of an elbow connector 10 or equivalent. The cord 8 also passes over two pulleys—a first pulley 9 located within the elbow 10, and a second pulley 11 located at the far end of the horizontally disposed tube 5 past the back edge of the sliding door. The second pulley 11 has a ball bearing encased in the centre of it, and is fastened through the centre by a screw to the pulley support bracket 12. A sleeve 14 is placed over the pulley with only just enough clearance not to touch the pulley 11. This sleeve 14 is fastened to the support bracket 12 and has two holes 14*a* and 14*b* to allow the cord 8 in and out of the pulley 11, respectively. This arrangement ensures that when the door is manually closed, overriding the automatic door closer, the cord 8 will slacken until the slowly falling weight 1 (described below) catches up and takes up the slack again, and the cord will not snag or drop off the pulley 11 in the process.

Figure 1:
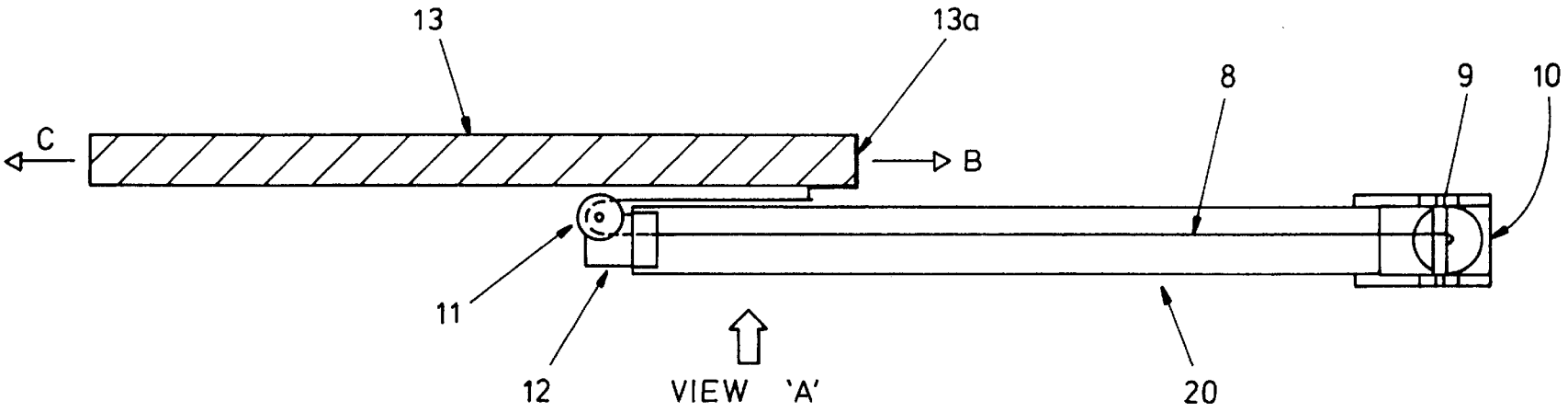
Figures 1A, 2:
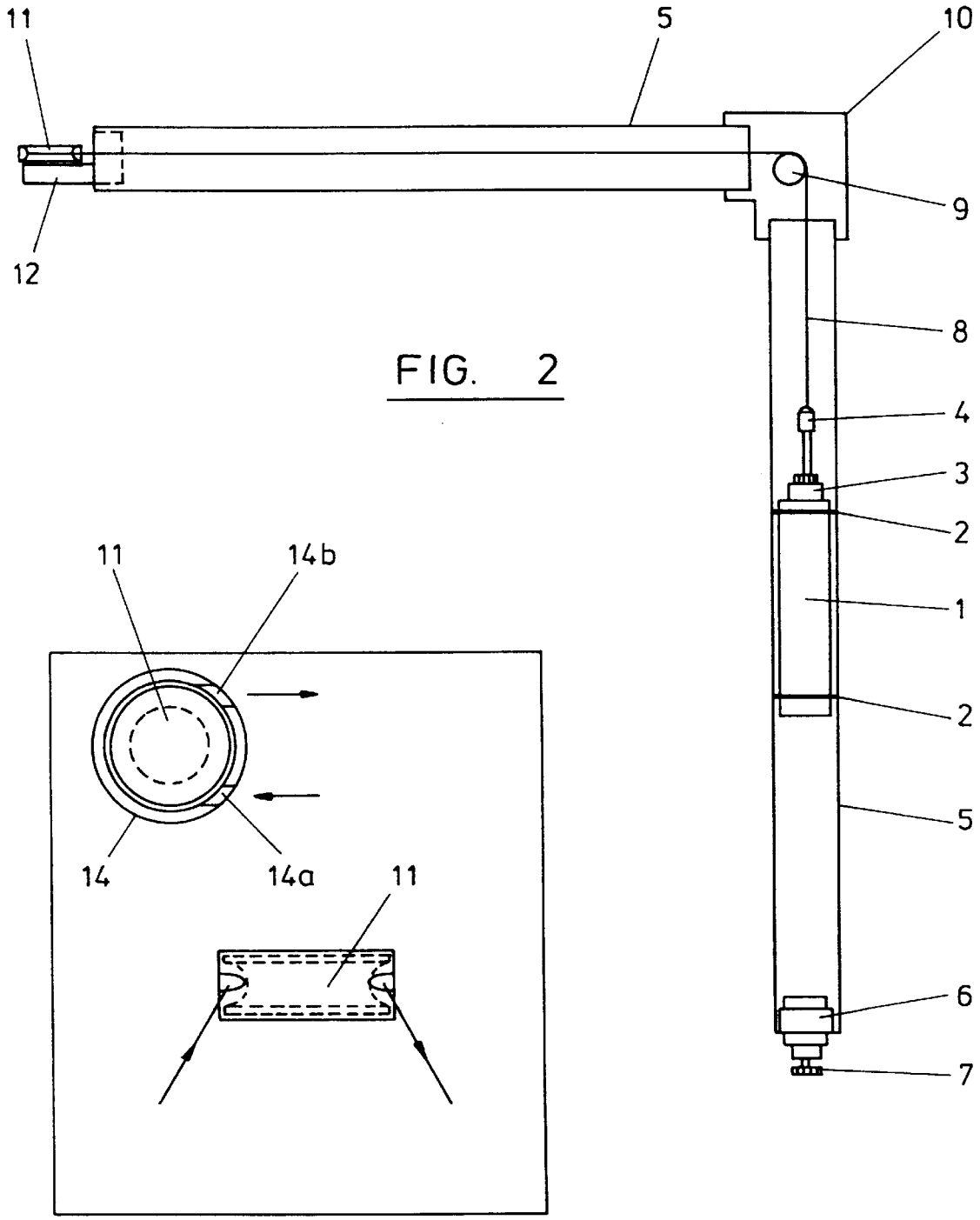
FIG. 2 is a view on arrow A.
Figure 3A:
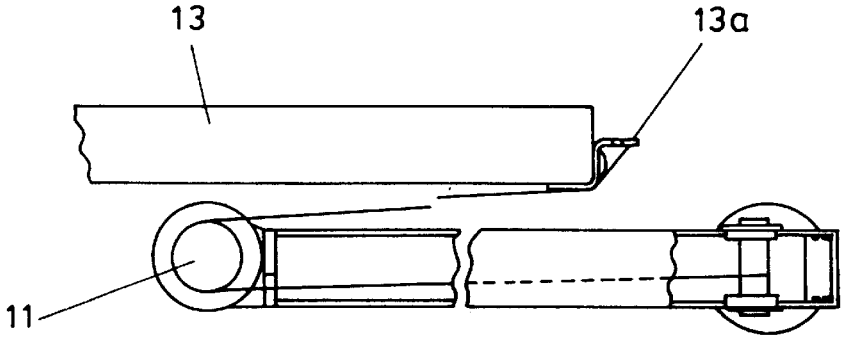
FIG. 3A is a view on arrow B of FIG. 3.
Figure 3:
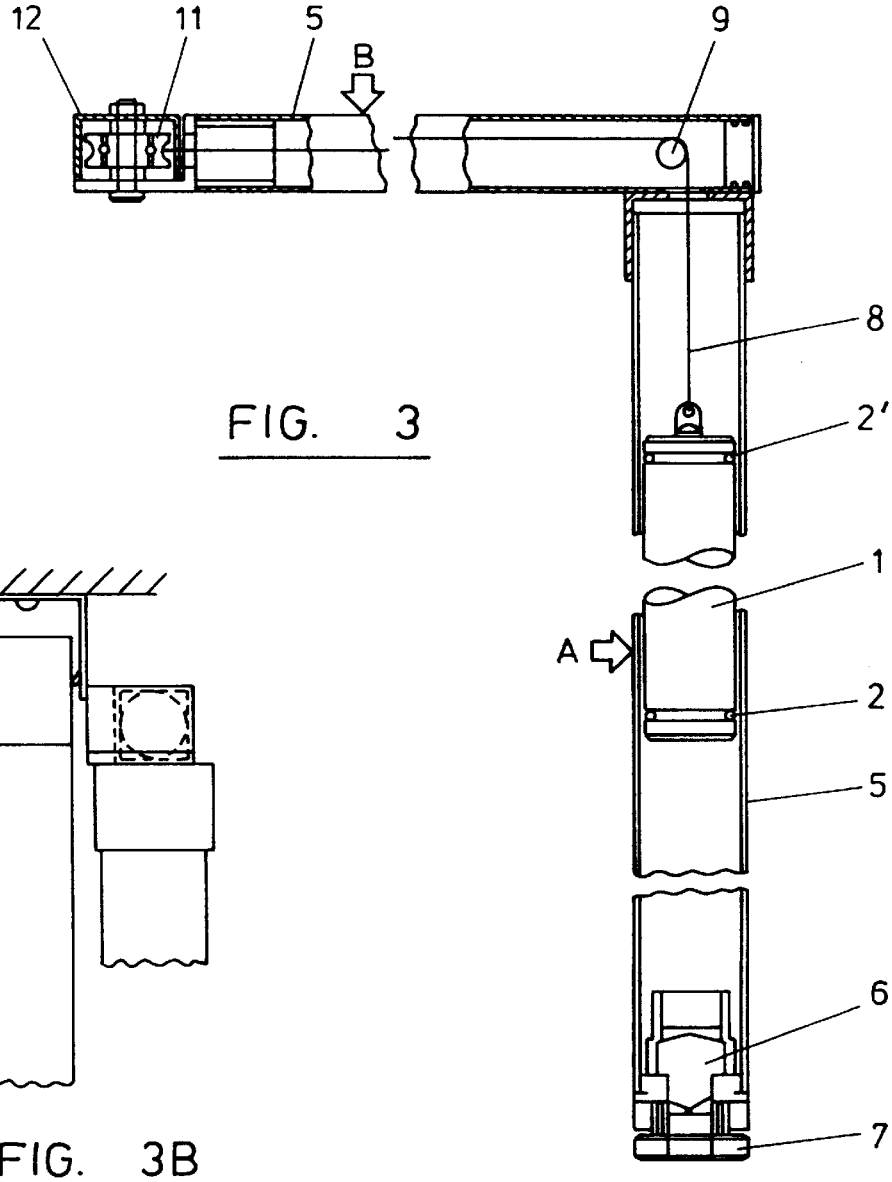
FIG. 3 illustrates the arrangement shown in FIG. 2 but in more detail.
Figure 3B:
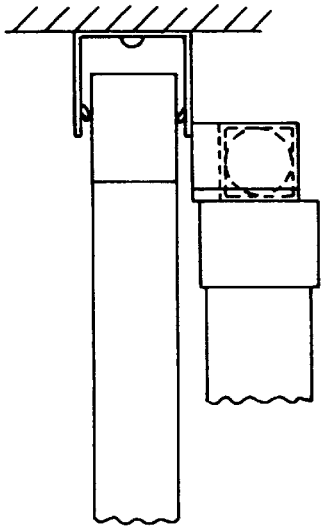
FIG. 3B is a view on arrow A of FIG. 3.

In one embodiment shown in FIGS. 2 and 3, the weight takes the form of a piston 1 and is sealed within the vertically disposed tube 5 by means of at least one air seal 2, preferably two, one at each end of the generally cylindrical shaped piston. Alternatively (see FIG. 3), there may be only a single air seal 2 at the bottom end of the piston and a stabilisation ring 2' at the upper end of the piston. At the bottom of the vertical tube 5 there is located a by-pass flow control valve comprising a one way flow valve 6 with a screwed sleeve terminating in a sleeve dial 7 underneath.

Upon sliding the door 13 manually into the open door position (arrow B), the piston is raised within the tube 5 and air is drawn in through valve 6, admitting air into the bottom of the tube 5, beneath the piston. Once the sliding panel 13 is released, the piston starts to fall under its own weight within tube 5, compressing the air trapped in the tube beneath it which is then released gradually through the slight gap between the valve 6 and its associated seal. By setting the sleeve dial 7 to the desired rate of airflow, the piston 1 can be made to fall steadily and at the desired rate to achieve smooth door closing, following the initial air compression.

The cord 8 is fastened to the top of weight 1 by means of a captive nut 4, and small additional weights such as 3 may be provided to alter the overall weight of the piston to suit a particular door assembly.

To install the apparatus to an existing door assembly, all that is required is to screw or otherwise attach bracket 13*a* to the edge of the sliding panel 13, and fix the two tubes 5 to a suitable position on or adjacent the door assembly.

Figure 4:
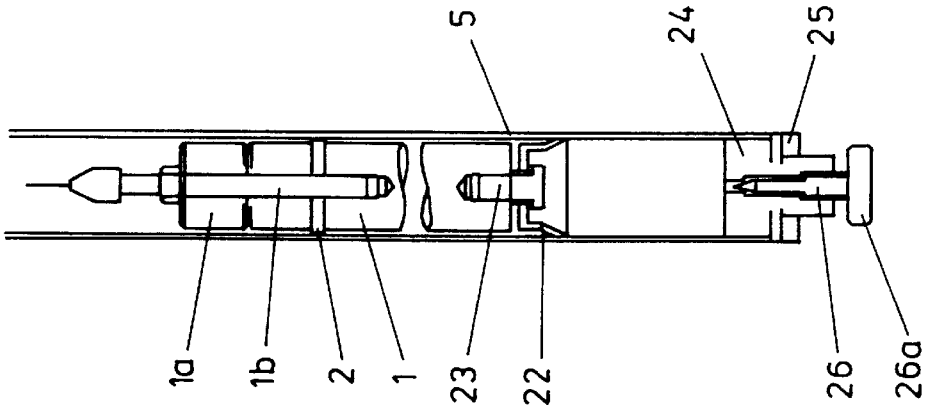

In an alternative embodiment shown in FIGS. 4 through 4C, the lowermost seal 2 is replaced by a combined seal/one way valve 22 which is generally cup-shaped with an outer rim or flange which engages the inside of tube 5 as well as a number of air flow grooves 22*a*. This seal is attached to the base of the piston 1 by means of a flanged spigot 23 which is held captive within the seal but which is capable of limited axial movement relative to the seal 22 during movement of the piston 1. As illustrated in FIGS. 4A and 4B, when the piston 1 moves upwards, an air space is created betweeen the bottom of piston 1 and the sealing face 22*b* of the seal 22, allowing air to flow through the air flow grooves 22*a* in seal 22. When the piston 1 falls, the spigot 23 moves downwards relative to seal 22, causing the bottom face of the weight 1 to come into sealing engagement with the sealing face 22*b* of seal 22, thus compressing the air below. The bottom end of the tube 5 in this embodiment terminates in an end plug 24 and muffler 25, the former including an internally threaded axial hole of graded diameter therein which accommodates an elongate threaded member arranged to increase or decrease the air gap between the member and the hole in the end plug, according to whether the knurled knob 26*a* is rotated in one direction or the other, thus altering the rate at which the air can escape from the tube 5 beneath the piston 1.

FIG. 4 also illustrates the inclusion of additional weights 1*a*, 1*b* on top of the main weight 1.

The seal shown in FIGS. 5A, 5B and 5C is an alternative to the seal shown in FIGS. 4A, 4B and 4C. Instead of grooves 22*a*, the seal 30 has a series of eight circular holes 30B positioned evenly around a central hole 30A. Central hole 30A is for location and positioning when the seal 30 is assembled onto the end of the piston 1, and the holes 30B are for air to pass through, allowing the seal to act as a valve.

Referring now to FIGS. 6 through 9, the apparatus 20 is installed to standard six foot wide sliding doors 40, by screwing top and bottom tube clips 42, 44, which hold the vertical tube 51, to the fixed door side wall 43 remote from the door panel 13 when in the closed position. The free end of cord 8 is secured with adhesive in cord anchor bracket 46 attached to the back edge 13*b* of the sliding door 13. Other features illustrated in FIG. 8 include floating seal 41, anti-scuffing disk 45, speed control 48, cord cap 50, and alignment step 52, the latter engaging within the overhead channel 54. The adjustable weighted piston 1 includes three additional weights 3, amounting in total to a maximum of 6 lbs, to provide a pneumatically controlled counter balance system, as previously described.

I claim:

1. An apparatus for automatically closing a sliding door comprising a weight (1) for operative connection (8) to a sliding panel (13) forming part of a sliding door assembly such that sliding the panel into the open door lifts the weight (1) which then falls again once the sliding panel is released, thus closing the door, said apparatus comprises:

a fixed vertically extending pneumatic tube (5) wherein the weight in the form of a piston (1) is guided, and a pulley (9) for guiding a cable (8) adapted to be fixed to the sliding panel (13), wherein the movement of the piston within the pneumatic tube is dampened by means of check valve (22) and throttle (26) allowing admission and restricted outflow of air respectively, characterized by, the pneumatic tube Joined to a horizon-ally extending second tube by an elbow (10), wherein the elbow houses the cable and the pulley (9), and the horizontally extending second tube houses the cable (8) and supports at the distal end thereof a second pulley (11), such that the end of the cable when fixed to the moving panel closes the moving panel by weight of the piston (1) in a direction away from the pneumatic tube (5).

2. Apparatus according to claim 1, wherein the pneumatic tube is closed at its bottom end, and the piston includes air seals which create an airtight seal with the inner surface of the tube.

3. Apparatus according to claim 2, wherein one or more air valves are included in the pneumatic tube at or close to the bottom end thereof.

4. Apparatus according to claim 3, wherein there are provided additional weights to be attached onto or adjacent the piston, for use with different door assemblies.

5. Apparatus according to claim 2 wherein there is provided a single air valve in the form of a by-pass flow control valve, comprising a one-way flow valve with a screwed sleeve underneath.

6. Apparatus according to claim 5, wherein there are provided additional weights to be attached onto or adjacent the piston, for use with different door assemblies.

7. Apparatus according to claim 2 wherein there is provided a combined seal/one way valve fixed to the piston and adapted such as to allow air to flow through the seal when the piston is lifted upon opening the door, but to prevent such air flow when the piston is falling, thereby creating a substantially airtight seal and compressing the air within the tube beneath the piston, permitting smooth closing operation.

8. Apparatus according to claim 7, wherein there are provided additional weights to be attached onto or adjacent the piston, for use with different door assemblies.

9. Apparatus according to claim 2, wherein there are provided additional weights to be attached onto or adjacent the piston, for use with different door assemblies.

10. Apparatus according to claim 1, wherein there are provided additional weights to be attached onto or adjacent the pistol, for use with different door assemblies.

11. A method of converting a manually operated sliding door assembly having at least one sliding panel into one which closes automatically, the method comprising mounting onto the door assembly an apparatus according to claim 1.

12. An automatically closing sliding door assembly including at least one sliding panel, including an apparatus according to claim 1.

* * * * *

UNITED STATES PATENT AND TRADEMARK OFFICE

CERTIFICATE OF CORRECTION

PATENT NO. : 6,065,184
DATED : May 23, 2000
INVENTOR(S) : Malcolm Drury

It is certified that error appears in the above-identified patent and that said Letters Patent is hereby corrected as shown below:

Column 4, Line 2 of Patent; after "tube" delete "51" and insert therein --5'--.

Column 4, line 17 of Patent; after "open door" insert therein --position--.

Column 4, line 28 of Patent; after "tube" delete "Joined" and insert therein --joined--.

Column 4, line 29, of Patent; after "joined to a" delete "horizon-ally" and insert therein --horizontally--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*